United States Patent [19]

Cobb et al.

[11] 4,252,475

[45] Feb. 24, 1981

[54] VEHICLE MOUNTED TEMPORARY ROOF SUPPORT

[75] Inventors: William R. Cobb, Murrysville; Henry P. Barthe, Pittsburgh, both of Pa.

[73] Assignee: Schroeder Brothers Corporation, McKees Rocks, Pa.

[21] Appl. No.: 30,217

[22] Filed: Apr. 16, 1979

[51] Int. Cl.[3] ..... E21D 15/59; E21C 11/02

[52] U.S. Cl. ..... 405/291; 173/23; 175/219; 405/290

[58] Field of Search ..... 405/288–303; 173/22, 23, 38, 34; 175/219; 182/112; 299/10

[56] References Cited

U.S. PATENT DOCUMENTS

| | | | |
|---|---|---|---|
| 2,574,857 | 11/1951 | Ball | 405/299 X |
| 2,711,634 | 6/1955 | Joy | 405/298 |
| 2,738,081 | 3/1956 | Lee | 173/22 X |
| 2,772,871 | 12/1956 | Caine | 405/298 X |
| 2,795,934 | 6/1957 | Jenkins | 405/300 |
| 3,892,100 | 7/1975 | Jamison | 405/291 |
| 4,026,118 | 5/1977 | McCay | 405/291 |
| 4,079,792 | 3/1978 | Paul et al. | 175/219 X |
| 4,108,253 | 8/1978 | Woodford | 405/303 X |

*Primary Examiner*—Dennis L. Taylor

*Attorney, Agent, or Firm*—Webb, Burden, Robinson & Webb

[57] ABSTRACT

A temporary roof support for mounting to a mining vehicle comprising a boom pivotally mounted to the vehicle and positioned in front thereof for rotation in a vertical plane and an extensible standard pivotally mounted to the front of said boom. An extensible hydraulic device secured at one end to the standard and at the other end to the boom adjusts the angular relationship therebetween. A transverse beam is mounted to the top of the standard for restricted angular movement.

5 Claims, 6 Drawing Figures

VEHICLE MOUNTED TEMPORARY ROOF SUPPORT

BACKGROUND

It is a requirement of the mine safety laws that in most instances temporary roof supports must be positioned before a miner can enter the space below an unbolted or otherwise permanently supported roof. Until recenty, it has been neccessary for miners to enter under the unsupported roof to place temporary support jacks. Roof bolting devices have been proposed in which a canopy generally positioned over the operator may be raised to engage the roof. It has also been proposed to provide a swinging boom type temporary roof support extending from the chassis of the roof bolting machine. The boom is connected to the chassis for angular movement about more than one axis. The end of the boom supports one small area directly surrounding the point where the boom engages the mine roof. A considerable moment is placed upon the vehicle if roof collapse loads the swinging boom. Prior art temporary roof supports are disclosed in U.S. Pat. Nos. 4,079,792; 3,893,520; and 3,768,574, for example.

It is an advantage according to the applicants' invention to provide a temporary roof support carried by the chassis of a roof drilling and bolting machine or the like on a boom extending forwardly of the chassis. The boom is pivotally secured to the chassis for rotation about one axis only. An extensible standard pivotally secured to the opposite end of the boom is vertically positoinable and extensible such that load is not transferred to the vehicle by the boom after the extensible standard is emplaced.

SUMMARY OF THE INVENTION

Briefly, according to this invention, there is provided a temporary roof support comprising an elongate boom pivotally mounted and positioned on the front of a mining vehicle for rotation about one axis. The boom then sweeps a vertical plane when rotating about the said axis. An extensible standard is pivotally mounted to the front of said boom. An extensible hydraulic device (hereafter "tilt ram") is secured at one end to the boom and at the other end to the standard for establishing the angular relationship therebetween. More precisely, this tilt ram is used to adjust the standard to a desired, for example true vertical, position notwithstanding the extent of the extension thereof. A cap on the top of the extensible standard pivotally supports a transverse beam for restricted angular movement. According to preferred embodiments, the cap and the standard are joined by extensible hydraulic devices (hydraulic pistons and cylinders) for adjustably separating the cap from the standard to thereby extend the standard. According to yet another preferred embodiment, there is associated with the standard a foot pad and an extensible hydraulic means between the foot pad and the standard for adjustable separation of the foot pad and the standard to thereby further extend the extensible standard. According to a further preferred embodiment, the temporary roof support comprises a beam support housing in which the boom is pivotally mounted. The housing is mounted in turn to the front of the mining vehicle and directly to the frame thereof. The housing has a bottom stop that supports the boom at its most downward swinging position. An extensible hydraulic device (boom rotation ram) is pivotally mounted at one end to the boom support housing and at the other end rests in a socket attached to the boom. Thus the boom can be rotated upwardly by extension of the boom rotation ram. When the boom or any attachment thereto strikes the mine floor during tramming or when the extension of the extensible standard would cause the boom to rotate upwardly, the end of the boom rotation ram and the socket in which it rests simply separate.

DRAWINGS

Further features and other objects and advantages of this invention will become clear from the following detailed description made with reference to the drawings in which.

DESCRIPTION OF THE PREFERRED EMBODIMENTS

This invention relates to a temporary roof support which has particular application to a roof bolting device as disclosed in our co-pending application filed of even date herewith entitled "Roof Bolting Device" and bearing Ser. No. 030,219.

Figure 1:
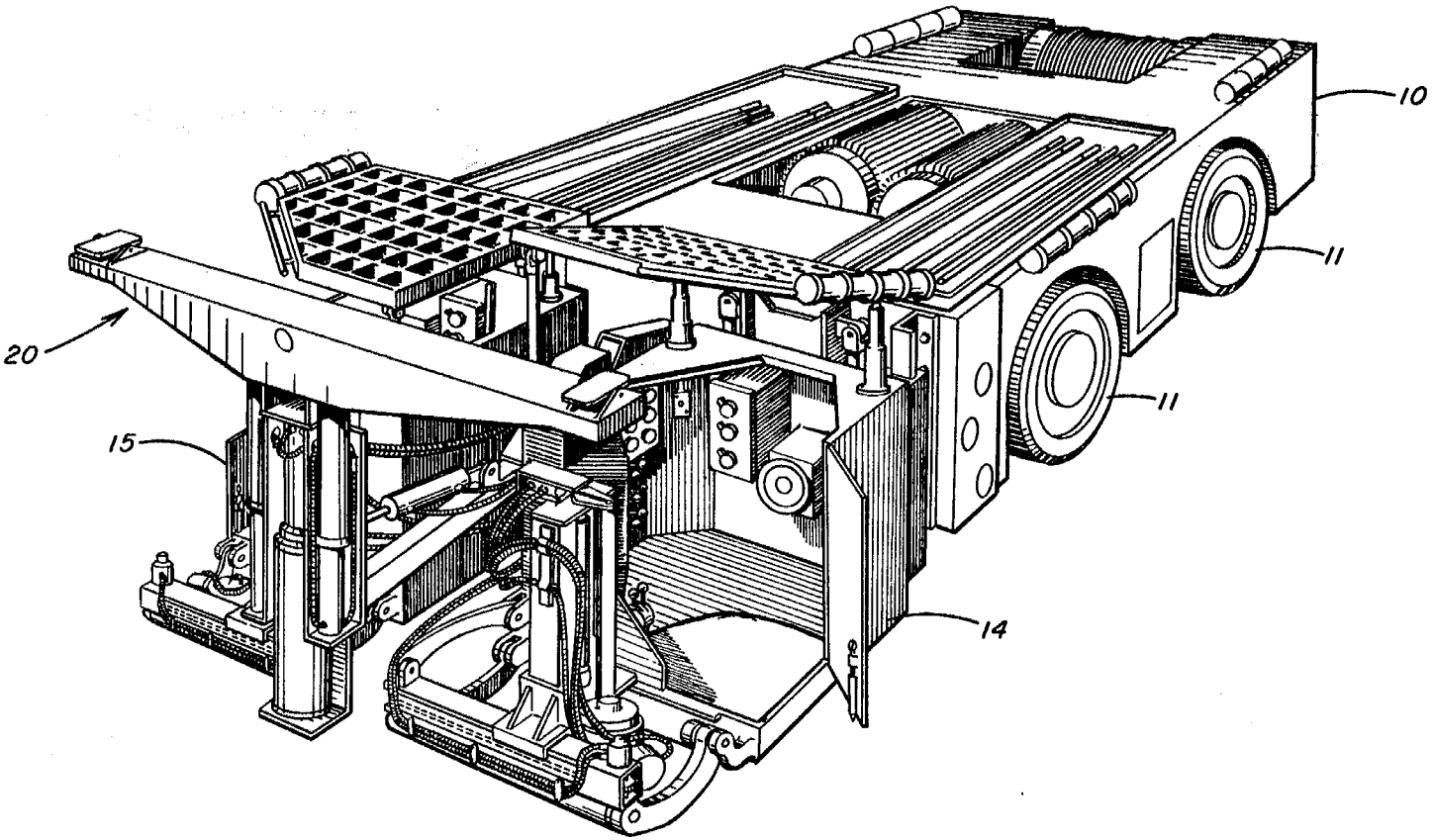
FIG. 1 is a schematic perspective of a machine with our temporary roof support shown with certain reinforcing elements removed to better illustrate the functional elements.

Referring to FIG. 1, there is shown a roof drilling and bolting machine comprising a chassis 10 mounted on wheels 11. At the front of the machine art two operator cabs 14 and 15. Positioned in front of the cabs is a temporary roof support 20 according to this invention.

Figure 2:
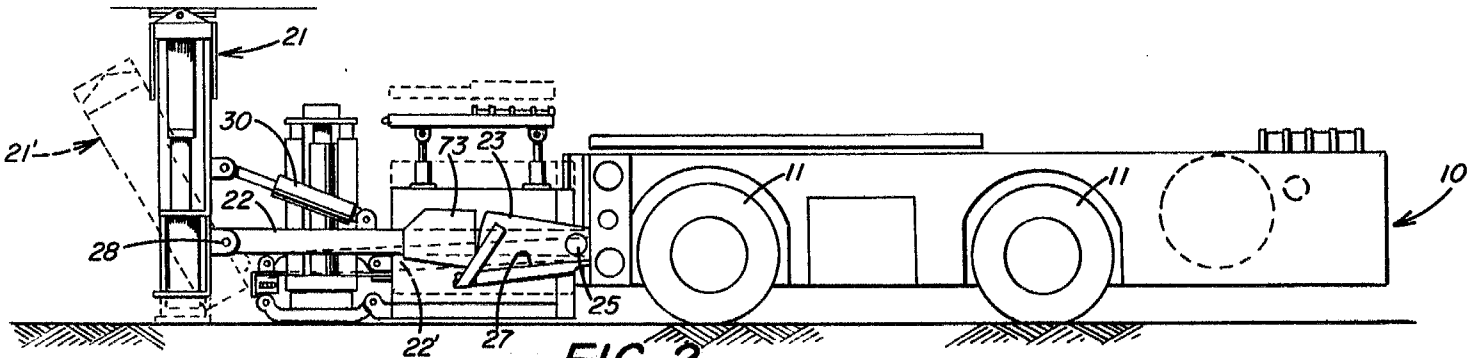
FIG. 2 is a schematic side elevation of a machine having our temporary roof support with certain parts omitted. One operator cab has been removed to better illustrate the positioning of the temporary roof support.
Figure 6:
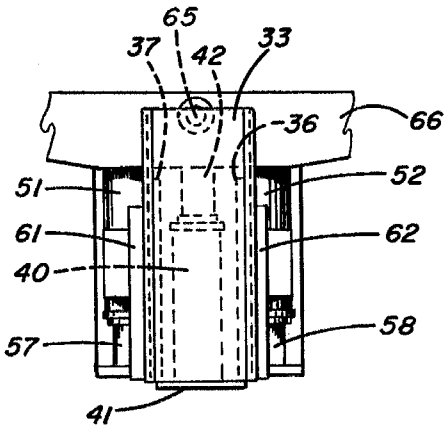
FIG. 6 is a side elevation of our temporary roof support.
Figure 3:
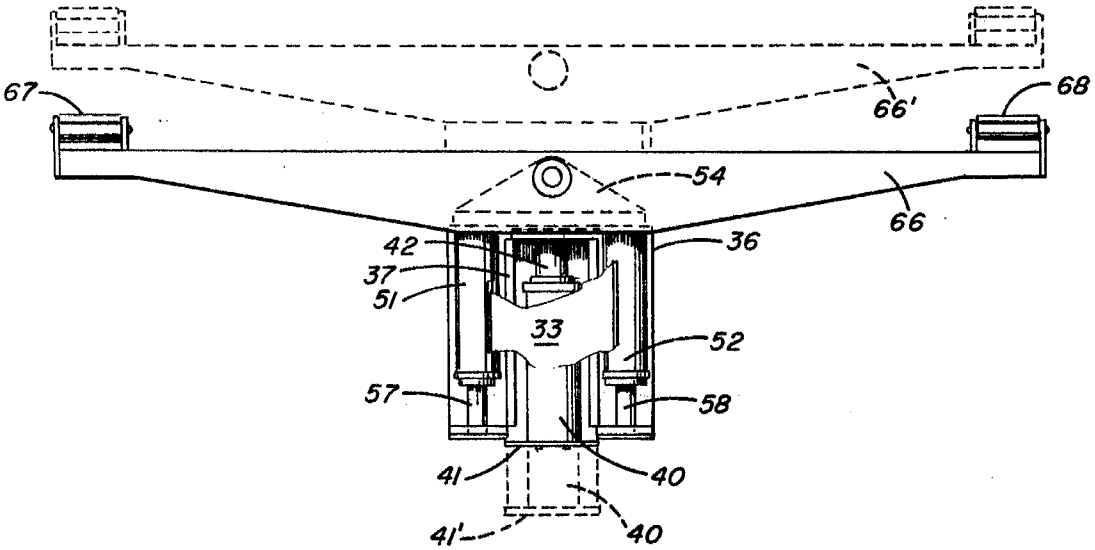
FIG. 3 is a broken away front elevation of our temporary roof support illustrating the extension of the standard.

Referring now to FIG. 2, the temporary roof support comprises an extensible standard 21, a boom 22 and a boom support housing 23. The boom support housing 23 is secured to the frame of the chassis 10. The boom 22 is pivoted within the boom support housing near the front of the chassis upon a pin 25 which is journaled in the boom support housing. The bottom 27 of the boom support housing restricts the downwardmost swing of the boom. The extensible standard 21 may be rotated relative to the end of the boom due to a pivotal connection 28 therebetween. A tilt ram (hydraulic piston and cylinder) 30 is positioned between the boom and the standard for adjusting the angle therebetween. An alternate position of the extensible standard 21' and the boom 22' is shown by phantom lines. That position is one that the boom and standard might be placed in for tramming of the entire roof bolting vehicle. The boom can be raised and lowered during tramming as required to negotiate dips and peaks in the entry way.

The nature of the extensible standard 21 is best illustrated by reference to FIGS. 3, 4, 5 and 6. The extensible beam comprises a back section 31 to which the boom 22 and tilt ram 30 are pivtoally connected at 28 and 32. Secured to the back plate 31 is a front plate 33. The back plate and the front plate are joined by webs 36 and 37. The back plate, front plate and webs define the central unit of the extensible standard. A large hydraulic cylinder 40 is secured at its lower end to a bottom plate 41. The piston 42 is fixed relative to the central unit of the standard. Hence, when the hydraulic cylinder 40 is extended the bottom plate moves downwardly from the central unit of the standard. Two hydraulic cylinders 51 and 52 are secured at one end to a cap 54 over the top of the central unit of the extensible beam. The pistons 57 and 58 associated with the cylinders 51 and 52 respectively are secured to the central unit. Thus when the cylinders and rams 51, 52, 57 and 58 are elongated, the cap is raised relative to the central unit. Attached to the outer sides of each of the hydraulic cylinders 51 and 52 are guide plates 61 and 62 which engage guideways in the front plate 33 as shown in FIG. 5. The purpose of the guide plates 61 and 62 which ride in trackways in the front plate 33 is to provide the extended extensible standard with resistance to buckling moments. The above described extensible standard has the capability of extending to at least twice its compressed height.

The cap 54 carries journaled therein pivot pin 65. Pivotally mounted to the pivot pin is a horizontal beam 66. Pivotally mounted pads 67 and 68 are secured at the outer extensions of the horizontal beam 66.

Figure 4:
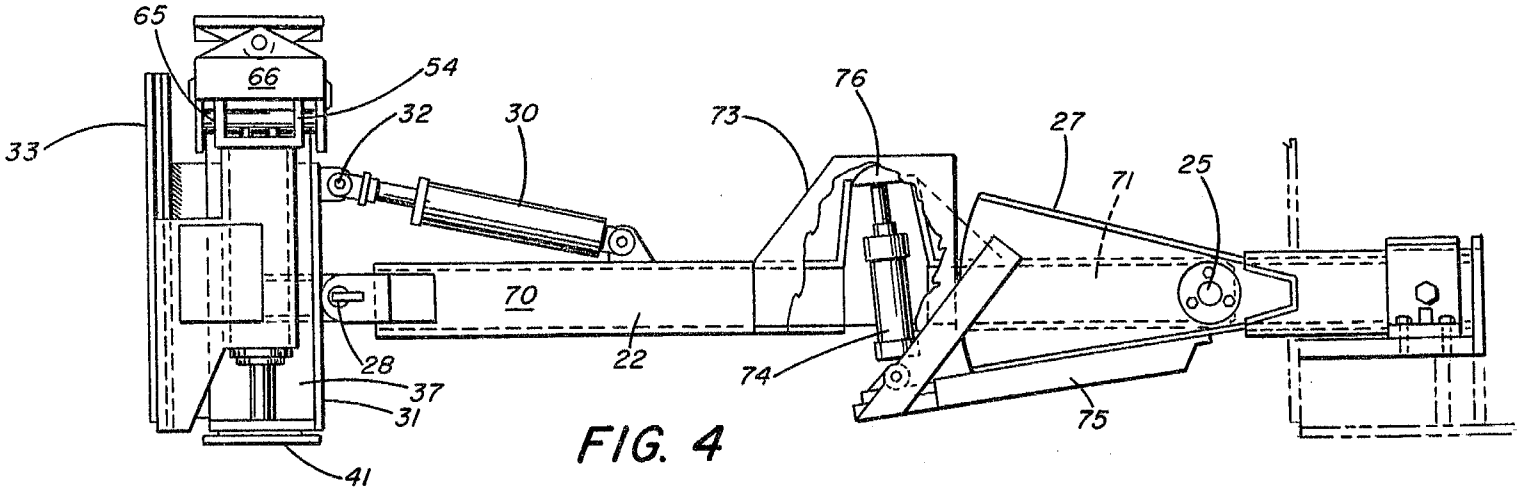
FIG. 4 is a broken away side elevation of our temporary roof support illustrating the details of the support housing.
Figure 5:
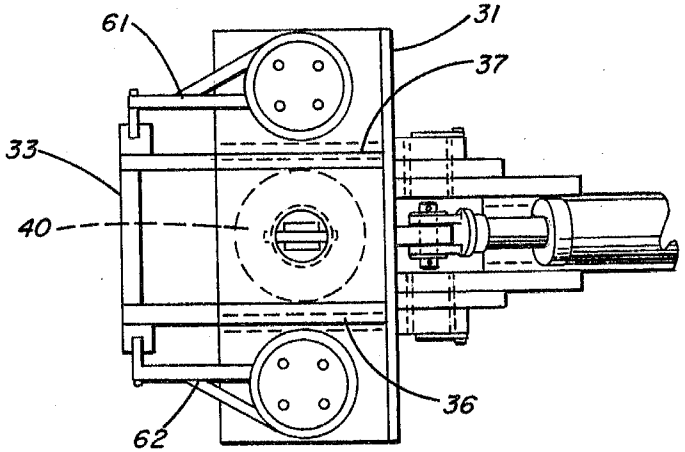
FIG. 5 is a plane view of the standard of our temporary roof support with the cap and beam removed.

The boom 22 is comprised of two sections 70 and 71 which are joined together by a lifting box 73 (see FIG. 4). A boom rotating ram 74 is pivotally mounted to an extension 75 of the beam support housing 27. At the other end, the ram (extensible hydraulic device ) rests in a socket 76. The entire boom 22 can be swung upwardly by extension of the hydraulic device 74. However, if during tramming the standard or attachments thereto engage the mine floor, the boom may be rotated upwardly without extension of the hydraulic device 74 simply by the socket 76 pulling away from the upper end of the hydraulic device 74.

OPERATION

When the vehicle is being trammed, it is preferable if the cylinder 74 is elongated to raise the boom slightly and the tilt ram 30 is extended to tilt the extensible section forward. The hydraulic pistons 57, 58 and 42 are withdrawn within their associated cylinders to collapse the extensible standard to its lowest height. Upon reaching a work location, the tilt ram 30 is adjusted to bring the standard to an upright position. Thereafter the hydraulic cylinders and associated rams in the extensible standard are elongated until the bottom plate engages the mine floor and the pads on the horizontal beam engage the mine roof. As these cylinders are being extended, the cylinder 30 is adjusted to maintain the standard in an upright position. The last extension of the standard should be made by pushing the cap upwardly rather than pushing the bottom plate downwardly, as this does not affect the vertical alignment of the standard. It is not necessary to adjust cylinder 74 if the downward movement of the bottom plate carries the boom 22 upwardly. The seat 76 simply moves away from the extensible means 74.

Having thus defined our invention in the detail and particularity required by the Patent Laws, what is desired protected by Letters Patent is set forth in the following claims.

We claim:

1. A temporary roof support comprising
   a boom pivotally mounted and positioned on the front of a mining vehicle for rotation in a vertical plane including the said boom,
   an extensible standard pivotally mounted to the front of said boom,
   an extensible hydraulic means pivotally mounted centrally of said boom and to said standard for establishing the angular relation therebetween,
   a transverse beam, and
   said extensible standard having a cap for pivotally supporting the transverse beam for restricted angular movement.

2. The roof support according to claim 1 wherein the cap and standard are joined by extensible hydraulic means for adjustable separation.

3. The roof support according to claims 1 or 2 wherein the standard has associated therewith a foot pad and the standard and foot pad are joined by extensible hydraulic means for adjustable separation.

4. A temporary roof support according to claim 1 further comprising two roof engaging pads pivotally mounted on an axis parallel to the top surface of the transverse beam on the top of said beam at the extremes thereof.

5. A temporary roof support comprising
   a boom pivotally mounted and positioned on the front of a mining vehicle for rotation in a vertical plane including the said boom,
   an extensible standard pivotally mounted to the front of said boom,
   an extensible hydraulic means pivotally mounted centrally of said boom and to said standard for establishing the angular relation therebetween,
   a transverse beam,
   said extensible standard having a cap for pivotally supporting the transverse beam for restricted angular movement,
   a boom support housing in which the boom is pivotally mounted, said housing being mounted in turn to the front of the mining vehicle, said housing having vertical side walls for supporting the boom against lateral movement, said housing having a bottom that supports the boom in its most downward position, and
   extensible hydraulic means pivotally mounted at one end to the boom support housing and at the other end resting in a socket attached to said boom,
   such that the boom may be rotated upwardly by extension of the extensible hydraulic means and may move upward from the position established by the extensible means without further extension of the extensible means.

* * * * *